US005434335A

United States Patent [19]

Brummond et al.

[11] Patent Number: 5,434,335

[45] Date of Patent: Jul. 18, 1995

[54] MOLTEN SALT DESTRUCTION OF ENERGETIC WASTE MATERIALS

[75] Inventors: William A. Brummond, Livermore; Ravindra S. Upadhye, Pleasanton; Cesar O. Pruneda, Livermore, all of Calif.

[73] Assignee: The Regents of the University of California, Oakland, Calif.

[21] Appl. No.: 79,930

[22] Filed: Jun. 23, 1993

[51] Int. Cl.[6] ..... C06B 43/00

[52] U.S. Cl. ..... 588/201; 588/202; 588/203; 149/124

[58] Field of Search ..... 588/201, 202, 203; 149/124

[56] References Cited

U.S. PATENT DOCUMENTS

| | | | |
|---|---|---|---|
| 3,017,256 | 1/1962 | Richardson | 422/180 |
| 3,778,320 | 12/1973 | Yosim et al. | 149/109.2 |
| 4,145,396 | 3/1979 | Grantham | 423/22 |
| 4,351,819 | 9/1982 | Riegel et al. | 423/488 |
| 4,447,262 | 5/1984 | Gay et al. | 75/65 R |
| 4,602,574 | 7/1986 | Bach et al. | 110/346 |
| 4,655,839 | 4/1987 | Chao et al. | 106/105 |
| 4,992,567 | 2/1991 | Meyer et al. | 549/532 |
| 5,211,777 | 5/1993 | Nahlovsky et al. | 149/109.6 |

OTHER PUBLICATIONS

Upadhye et al., "Destruction of High Explosives and Wastes Containing High Explosives Using the Molten Salt Destruction Process", 23rd International Annual Conference of ICT: Waste Management of Energetic Materials and Polymers, Jun. 30–Jul. 3, 1992, Karlsruhe, Germany, UCRL-JC-109564 (released to OSTI on Oct. 29, 1992).

*Primary Examiner*—Ngoclan T. Mai
*Attorney, Agent, or Firm*—Henry P. Sartorio; Daryl S. Grzybicki

[57] ABSTRACT

A molten salt destruction process is used to treat and destroy energetic waste materials such as high explosives, propellants, and rocket fuels. The energetic material is pre-blended with a solid or fluid diluent in safe proportions to form a fluid fuel mixture. The fuel mixture is rapidly introduced into a high temperature molten salt bath. A stream of molten salt is removed from the vessel and may be recycled as diluent. Additionally, the molten salt stream may be pumped from the reactor, circulated outside the reactor for further processing, and delivered back into the reactor or cooled and circulated to the feed delivery system to further dilute the fuel mixture entering the reactor.

17 Claims, 4 Drawing Sheets

MOLTEN SALT DESTRUCTION OF ENERGETIC WASTE MATERIALS

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the destruction of energetic waste materials, such as high explosives, propellants, and rocket fuels, in a molten salt reactor. In particular, the method provides side stream delivery of a premixed blend of the energetic material into a molten salt bath, with continuous recycling of the molten salt.

2. Description of Related Art

The development of environmentally acceptable methods for treatment and disposal of large quantities of high explosives (HE) and other energetic materials is a growing concern and a research goal of industry and federal laboratories. Current methods for disposal of energetic waste include open-pit burning, incineration, and detonation. These methods of bulk destruction generate hazardous products from the incomplete combustion of organic material. Safe methods must be devised that can completely combust or treat hazardous and mixed wastes in waste-processing plants.

Molten salt destruction (MSD) processes have been demonstrated for wastes containing highly explosive material. Anti-Pollution Systems, Inc. originally developed MSD as a single stage process for destruction of organic wastes. The MSD process works well with pure hydrocarbons and those contaminated with inorganic compounds. MSD fully converts the organic constituents of the waste into non-hazardous compounds such as carbon dioxide, nitrogen, and water. Inorganic contaminants remain captive in the molten salt. In the case of mixed waste, the actinides in the waste are retained in the molten salt while the organic compounds are removed, thus converting the mixed waste into solely radioactive waste. The molten salt is changed periodically, and the inorganic contaminants and pure salt may be reclaimed.

The conventional MSD process is not adapted for energetic materials, which are addressed by the present invention. Energetic materials cannot be injected directly as in the conventional method, because of the danger of violent decomposition reactions when being introduced into the melt. Severe damage to the delivery system, and even the reaction vessel, is possible. A method is needed to safely deliver explosive material into a high temperature molten salt bath without premature detonation.

In addition, although the conventional MSD process works without salt recycling, a waste destruction process which includes the recirculation of salt is advantageous. In such a method, a slip-stream of salt can easily be removed from the recirculating salt for further processing, and then reintroduced into the reactor at various points. This method reduces the amount of process waste, permits temperature control of the molten salt, and improves mixing and turbulence in the reactor.

SUMMARY OF THE INVENTION

The present invention is a method for destroying energetic materials such as high explosives, propellants, and rocket fuels in a molten salt reactor. The molten salt destruction process is accomplished by rapid delivery of a safe mixture of energetic material and a diluent into a reactor containing a molten salt. The energetic material is either diluted with a fluid diluent or mixed with a solid diluent and heated to form a fluid fuel mixture. The diluent may be an organic or inorganic compound, but is typically the same salt that is used in the reactor. The dilution of energetic material serves two purposes: to create an easily handled fluid form for delivery into the reactor and to prevent back burn or propagation from reactions in the molten salt bath.

The molten salt in the reactor may comprise carbonates, sulfates, or halides of alkali metals or alkaline earth metals; typically, a eutectic mixture of carbonates is used. An oxidant gas, such as oxygen, may be introduced into the melt. The fluid fuel mixture is quickly fed into the reactor, where the combustible organic components of the energetic waste react with oxygen to produce gaseous waste products such as carbon dioxide, nitrogen, and water vapor. The waste gases are removed from the reactor and may be filtered before being released to the atmosphere. The inorganic components, in the form of ash, are captured in the molten salt bed as a result of wetting and dissolution of the ash.

A stream of molten salt, such as a carbonate, is collected from the reactor during operation and can be separated into carbonates, non-carbonate salts, and ash. The carbonates may then be used as diluent and recycled to the reactor; the non-carbonates and ash are disposed of appropriately. A continuous stream of molten salt may be pumped from the reactor, cooled, and circulated directly to the feed delivery system for mixing with the pre-blended energetic material. In addition, the molten salt stream can be removed for further processing, then circulated directly back into the reactor, rather than through the feed delivery system. The recycling and purification of molten salt improves the efficiency of energetic waste material processing.

DETAILED DESCRIPTION OF THE INVENTION

The present invention is a method for destroying energetic materials, including high explosives, propellants, and rocket fuels, in a molten salt reactor by side stream delivery of a pre-blended fuel mixture into a high-temperature molten salt bath, with optional continuous molten salt recycling. The invention provides a safe method for quickly introducing a highly combustible material into a molten salt bath, where destruction of the organic material takes place.

Figure 1:
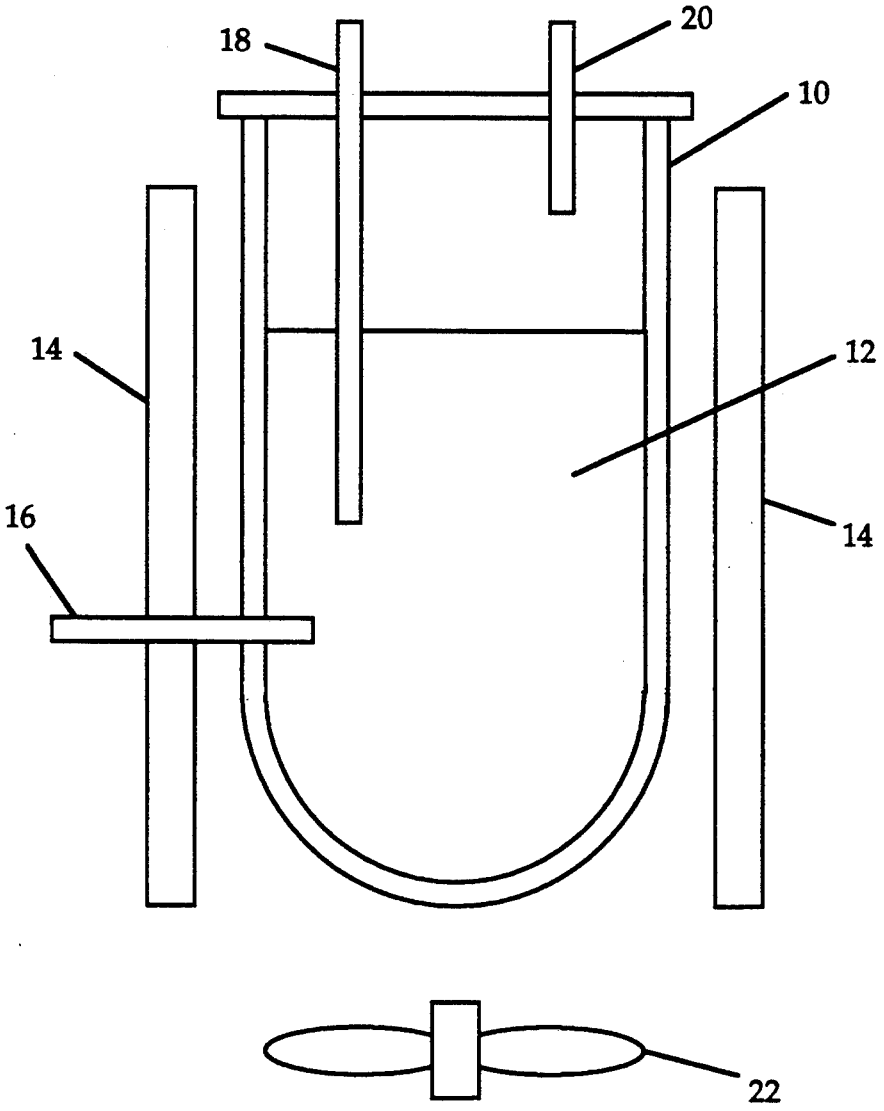
Figure 1 Prior Art
FIG. 1 shows a conventional molten salt reactor.

FIG. 1 shows a conventional setup for the molten salt destruction (MSD) process. A vessel or crucible 10 contains a molten salt 12, which is typically a carbonate or eutectic mixture of carbonates. The crucible 10 and salt 12 are heated using conventional external heaters 14. The material to be destroyed is fed into an injection tube 16. An oxidant gas, such as air or oxygen, is injected into the melt 12 through another tube 18. The by—product gases of the combustion reactions—carbon dioxide, water, and nitrogen—are exhausted through a gas pipe 20. Once the combustion process is established, the system is self-maintaining, and the heaters 14 can be turned off. To achieve higher throughputs of feed material, a cooling fan 22 may be used to cool the crucible and remove the reaction heat if needed.

Figure 2:
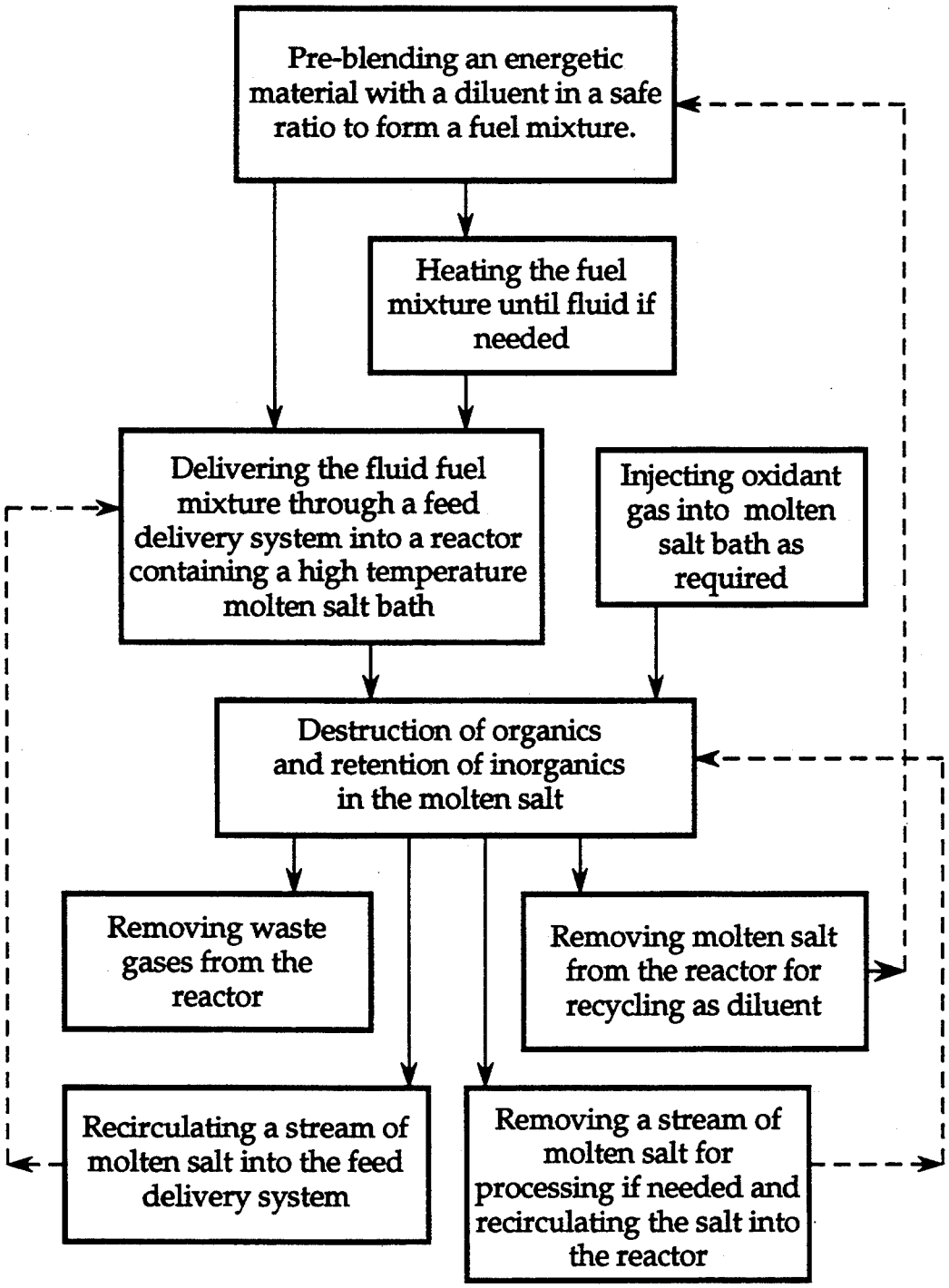
FIG. 2 is a flowchart of the present method for destruction of energetic materials.
Figure 3:
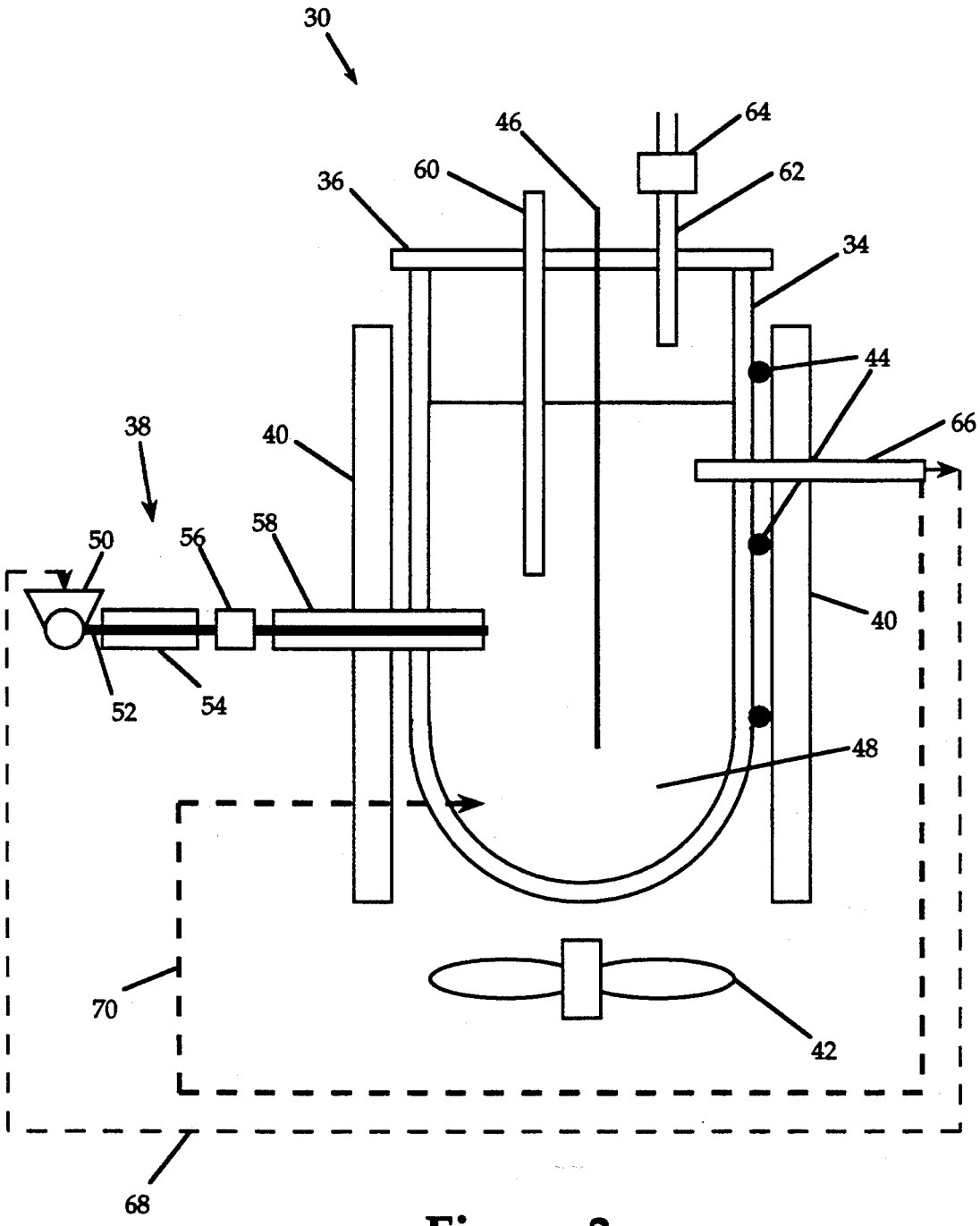
FIG. 3 shows a molten salt reactor with side stream delivery of the fuel mixture and possible recycling paths for the molten salt.
Figure 4:
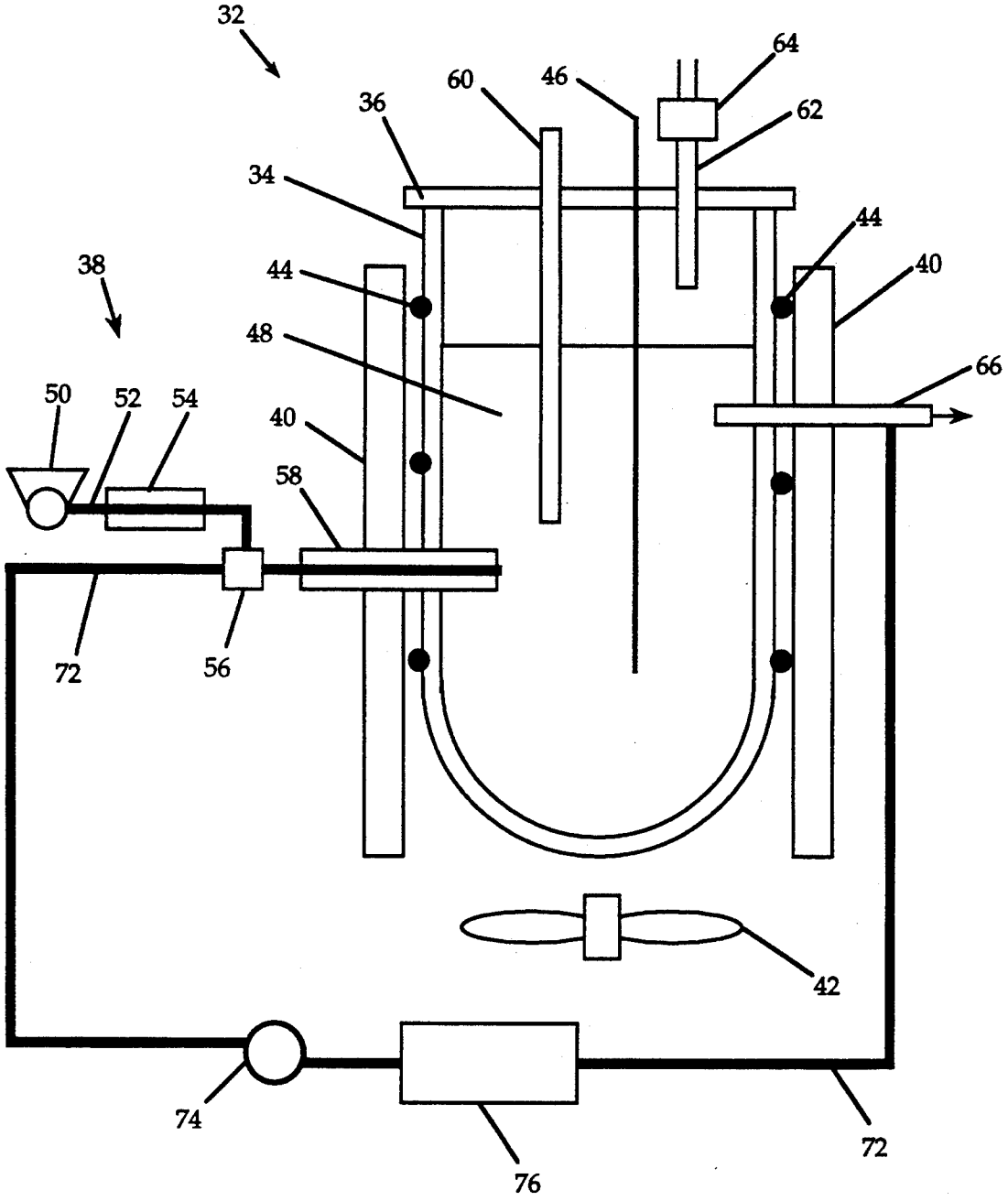
FIG. 4 shows a molten salt reactor with side stream delivery of the fuel mixture and continuous circulation of molten salt into the feed delivery system.

In the present invention, the MSD process is adapted for the special problems of delivering energetic materials to a high-temperature melt without detonation and back burn in the feed delivery system. FIG. 2 is a flowchart of the present method for safely delivering and destroying energetic materials in a molten salt reactor. FIGS. 3 and 4 show embodiments of reactors in which the MSD process takes place. The present process generally encompasses the steps of preparing the fuel mixture, delivering the mixture and optionally an oxidant gas into a molten salt bath, removing waste gases, and continuously recycling the molten salt.

Fuel Mixture Preparation

The energetic material, which may comprise high explosives, propellants, or rocket fuels, is first blended with a diluent to form a fuel mixture. The energetic material is typically in a pulverized form and is blended with a liquid or solid diluent. The diluent may be organic, such as mineral oil, or may be inorganic, such as water or a salt. Typically, the diluent is the salt (or salt eutectic mixture) used in the reactor.

The diluent provides a vehicle for handling the high energy material and keeps the concentration of energetic material to a safe dilution level. A minimum dilution factor is needed to introduce the energetic material into the molten salt bath without detonation or burning. This dilution level is dependent on the composition of the energetic fuel and is determined experimentally in specially designed equipment.

If the diluent is a solid, then the solid mixture is heated to form a fluid (or slurry) before being fed into the feed delivery system. If the solid fuel mixture is heated and melted, then its temperature must remain below the temperature needed to burn, detonate, or propagate burning or detonation of the energetic material. The energetic materials in the mixture will decompose (but not detonate) at higher temperatures when introduced into the molten salt bath.

Feed Delivery into the Molten Salt Reactor

The fluid fuel mixture is delivered to the molten salt bath through a feed delivery system. The fuel mixture may be metered into the system by either small batch loading or as a continual feed. The molten salt used in the reactor is usually chosen from carbonates, sulfates, and halides of alkali metals or alkaline earth metals. Typically, the molten salt bath comprises a eutectic mixture of two or more salts. Carbonates, bicarbonates, or sulfates of lithium, potassium, calcium, and sodium are preferred, either individually or as a eutectic mixture. The salts provide excellent heat transfer and reaction media and catalyze the oxidation of organic compounds. The salts also neutralize acid gases such as hydrogen chloride by forming stable salts like sodium chloride. The relatively high thermal inertia of the melt tends to resist changes in temperature resulting from sudden changes in the feed or heat transfer.

The energetic materials contain their own source of oxygen. The amount of internal oxygen is often sufficient to complete combustion, and an external supply of oxygen is unnecessary. In some cases, the amount of oxygen is insufficient for complete combustion. For example, in some cases the amount of internal oxygen is sufficient to convert all of the carbon to carbon monoxide, but not to carbon dioxide. Additional oxidant gas, such as oxygen or air, may be introduced from an external source into the molten salt. The organic compounds in the melt undergo oxidation reactions to form waste gases such as carbon dioxide, nitrogen, and water (steam). Any inorganic impurities remain captive in the molten salt.

Gaseous Waste Removal

In addition to the waste gases ($CO_2$, $H_2O$, and $N_2$) produced directly by the decomposition and oxidation of organic compounds, halogenated hydrocarbons in the waste generate acid gases such as hydrogen chloride (HCl) during the pyrolysis and oxidation processes occurring in the melt. These acid gases (HCl, HF) are scrubbed by the alkaline carbonates, such as sodium carbonate ($Na_2CO_3$), to produce steam, carbon dioxide, and the corresponding non-carbonate salt, like sodium chloride, according to the overall reaction $$2HCl + Na_2CO_3 \rightarrow 2NaCl + CO_2 + H_2O.$$

The waste gases from the reactor are sent through standard waste gas clean-up processing, such as fabric or HEPA filters, before being released to the atmosphere. The non-carbonate salts are retained in the melt.

Molten Salt Circulation and Recycling

A side stream of molten salt is removed from the reactor and may be monitored periodically for impurities. The salt can be purified to remove the contaminants, solidified, and then recycled by blending with the energetic material as the solid diluent in the preparation of the fuel mixture. The molten salt stream also may be circulated outside the reactor for possible processing and then fed directly back into the reactor. In addition, a continuous stream of recyclable molten salt may be drawn from the reactor and split into two streams. One stream may be circulated to the feed delivery system and introduced into the fuel mixture that is fed into the reactor. The other stream may be processed to remove ash and other products of the decomposition of the energetic material.

In the latter case, a stream of molten salt is typically pumped out of the reactor into a pipe and cooled to a temperature less than that needed for destruction of the energetic material. Care must be taken to ensure that the molten salt will not freeze or solidify at this lower temperature. The cooled, circulated molten salt is then added to the fuel mixture before delivery into the reactor. The circulated molten salt must be cooled before mixing so that the fuel mixture outside the reactor is kept at a temperature below the oxidation or decomposition threshold.

The recirculation and recycling of molten salt is advantageous for several reasons. A slip-stream of salt can easily be removed from the recirculating salt for further processing. For example, the salt stream is solidified and then recycled by mixing with the explosive waste to obtain the desired dilution before introduction into the molten salt reactor. This technique reduces the amount of molten salt waste, and the circulation of molten salt improves mixing and turbulence in the reactor. Also, the salt temperature can be controlled with a recycle stream; that is, the salt can be cooled below the temperature of decomposition of the energetic material before mixing the molten salt and energetic material.

Molten Salt Reactors

The MSD process described in FIG. 2 may be carried out in the molten salt reactors 30,32 shown in FIGS. 3 and 4. FIGS. 3 and 4 show a reactor vessel 34, which is fitted with a flange 36 on top and a feed delivery system 38 on the side. The reactor vessel 34 is typically made of stainless steel, which is stable in the presence of alkaline carbonates. Wastes with high chlorine content require more corrosion-resistant materials, such as high-temperature alloys or ceramics. Conventional heating elements 40 are used to heat the vessel 34 and a salt contained therein. Cooling means 42 may also be provided to remove the heat of reaction from the reactor 30,32 to prevent overheating. Thermocouples 44,46 may be placed at various locations on and inside the vessel 34 to monitor the temperature.

To begin processing, a known amount of salt or salt eutectic mixture 48 is introduced into the vessel 34 from the top, and the top flange 36 is secured. The energetic material and the diluent are blended in desired proportions to form a fuel mixture. The diluent is typically the same salt that is used in the reactor. The amount of dilution is dependent on a number of variables, including the physical and chemical nature of the feed delivery system, and a combination of theoretical and experimental considerations.

The fuel mixture, which may be a solid mixture, a fluid, or a slurry, is fed into a feeder 50 in the feed delivery system 38. The fuel mixture passes into an injection pipe 52 and may be heated if necessary until fluid by heating means 54. When the temperature of the molten salt 48 in the vessel 34 is high enough to promote decomposition of the energetic material (about 400° C.–900° C.), a delivery pump 56 rapidly delivers the fluid fuel mixture through an insulated feed tube 58 into the reaction vessel 34.

An oxidant gas, such as oxygen or air, may be introduced, if necessary, into the molten salt 48 through a tube 60 near the center of the vessel 34 to further stimulate oxidation reactions. When the fuel mixture is exposed to the molten salt bath, the decomposition reactions take place, releasing gaseous waste products such as carbon dioxide ($CO_2$), water (steam), and nitrogen ($N_2$). The gaseous products of the reactions are sent to an exhaust gas outlet 62, and the temperature at outlet 62 may be monitored by a thermocouple (not shown). The exhaust line 62 typically has a demister 64 to trap entrained liquid droplets.

As shown in FIGS. 3 and 4, a stream of excess molten salt 48 is continually removed through an outlet tube 66 and recycled. This recycling can be accomplished in a number of ways. As shown in FIG. 3, the used salt may be processed to remove inorganic impurities. The pure (or impure) salt may be solidified and recycled as diluent by blending with the energetic materials. This recycling is shown schematically as path 68. Alternatively or in addition, a stream of molten salt may be pumped from the reactor, circulated outside the reactor for further processing, and injected directly back into the reactor, as shown in path 70. This circulation path improves turbulence and mixing in the reactor 30.

A third method of recycling is illustrated in FIG. 4, where a side stream of salt 48 from the outlet tube 66 is pumped out into a piping loop 72 by pumping means 74. This salt is cooled by a heat exchanger 76 to a temperature less than that required for fuel decomposition and detonation propagation. The salt 48 is a specially tailored eutectic mixture that will not freeze at this temperature. The piping loop 72 leads back to the feed delivery system 38, where the circulated salt is blended with the fuel mixture entering the delivery pump 56. The recycling and circulation of the molten salt 48 improves the efficiency of the destruction process and reduces process waste.

Experimental Results

Applicants have successfully and safely destroyed a slurry of over 35 wt % of a typical high explosive (HE) material, HMX (octahydro-1,3,5,7-tetranitro-1,3,5,7-tetrazocine), in mineral oil. The mineral oil keeps the HMX concentration to a safe dilution level and provides a vehicle for handling the HMX. HMX contains sufficient oxygen (from nitro groups) to propagate a steady back burn without any additional oxygen.

The gas samples obtained during operation of the system were analyzed, and qualitative observations were made. First, no hydrogen cyanide (HCN) was found in the exhaust, indicating that this acid gas was neutralized by the alkaline carbonate, probably producing sodium cyanide (NaCN). Molten salts are known to be effective scrubbing agents for acid gases. Second, the amount of carbon monoxide was relatively small, indicating that the major combustion products are nitrogen, water, and carbon dioxide. The salt samples were analyzed for traces of the high explosive, HMX, to determine the extent of destruction; no HMX or decomposition products were detected in the salt to a sensitivity of 5 ppm.

Essentially similar experiments have been successfully completed with similar results for other high explosives such as RDX (hexahydro-1,3,5-trinitro-1,3,5-triazocine), PETN (2,2-Bis[{nitrooxy}methyl]-1,3-propanediol dinitrate, and TATB (2,4,6-trinitro-1,3,5-benzene triamine), and on a liquid gun propellant comprising HAN (hydroxyammonium nitrate) and TEAN (triethanol ammonium nitrate). Applicants have demonstrated that highly energetic materials can be safely and completely destroyed using the molten salt destruction process.

The foregoing description of preferred embodiments of the invention is presented for purposes of illustration and description and is not intended to be exhaustive or to limit the invention to the precise form disclosed. Many modifications and variations are possible in light of the above teaching.

We claim:

1. A method for destroying energetic waste materials in a reactor containing a molten salt bath, comprising:

(a) forming a fluid fuel mixture comprising an energetic material and a diluent in desired proportions;

(b) heating the molten salt bath to a temperature above the decomposition threshold for the fuel mixture;

(c) delivering the fluid fuel mixture into the molten salt bath through a feed delivery system, wherein the energetic material in the fuel mixture decomposes in the molten salt bath, forming waste gases;

(d) removing the waste gases from the reactor; and (e) removing a stream of molten salt from the reactor for recycling.

2. The method as recited in claim 1, wherein step (a) is carried out by:

(1) blending solid forms of the energetic material and the diluent; and (2) heating the solid forms to a temperature below the decomposition threshold of the energetic material to form a fluid fuel mixture.

3. The method as recited in claim 1, wherein step (e) is carried out by:

(1) solidifying the molten salt; and (2) using the solid salt as the diluent in step (a).

4. The method as recited in claim 3, is further carried out by:

(3) heating the solid salt and the energetic material to a temperature below the decomposition threshold of the energetic material to form a fluid fuel mixture.

5. The method as recited in claim 1, wherein step (e) is carried out by:

(1) circulating the stream of molten salt from the reactor to the feed delivery system; and (2) mixing the circulated molten salt with the fuel mixture before delivery into the molten salt bath in step (c).

6. The method as recited in claim 5, wherein the circulating step is carried out by:

pumping the molten salt stream from the reactor into a piping loop; and cooling the molten salt in the piping loop to a temperature below the decomposition threshold of the energetic material.

7. The method as recited in claim 1, wherein step (e) is carried out by:

(1) circulating the stream of molten salt from the reactor to another point external to the reactor; and (2) introducing the molten salt back into the reactor.

8. The method as recited in claim 7, further including: purifying the molten salt before recycling back into the reactor.

9. The method as recited in claim 7, further including: cooling the molten salt to a temperature above its freezing point before recycling back into the reactor.

10. The method as recited in claim 1, further including:

injecting an oxidant gas into the molten salt bath.

11. The method as recited in claim 1, wherein the energetic material is selected from the group consisting of high explosives, propellants, and rocket fuels.

12. The method as recited in claim 1, wherein the molten salt is selected from the group consisting of carbonates, sulfates, and halides of alkali metals; carbonates, sulfates, and halides of alkaline earth metals; and mixtures thereof.

13. The method as recited in claim 12, wherein the molten salt comprises a eutectic mixture of two or more salts.

14. The method as recited in claim 12, wherein the diluent and molten salt comprise the same salt or salt mixture.

15. The method as recited in claim 1, wherein the diluent is selected from the group consisting of carbonates, sulfates, and halides of alkali metals; carbonates, sulfates, and halides of alkaline earth metals; and mixtures thereof.

16. The method as recited in claim 15, wherein the diluent comprises a eutectic mixture of two or more salts.

17. The method as recited in claim 1, wherein step (c) is carried out by:

delivering the fuel mixture laterally into the reactor.

* * * * *